United States Patent [19]

Van Sluis et al.

[11] 4,050,467

[45] Sept. 27, 1977

[54] APPARATUS FOR ORIENTING TOBACCO LEAVES

[75] Inventors: Jan Adolf Van Sluis, Groningen; Frans Remko Reinhart, Leek, both of Netherlands; Johan Peter Johansen, Hon; Rolf Pedersen, Oslo, both of Norway

[73] Assignees: Koninklijke Bedrijven Theodorus Niemeyer B.V., Groningen, Netherlands; Joh. H. Andresen, Oslo, Norway

[21] Appl. No.: 691,213

[22] Filed: May 28, 1976

[30] Foreign Application Priority Data

May 28, 1975 Norway ..... 751889

[51] Int. Cl.[2] ..... A24B 5/08

[52] U.S. Cl. ..... 131/147 A; 100/151; 198/626

[58] Field of Search ..... 131/147, 145, 84 R, 131/84 A, 108, 109, 64.2, 66 R, 66 A, 123, 80; 100/151-154; 198/626

[56] References Cited

U.S. PATENT DOCUMENTS

| | | | |
|---|---|---|---|
| 2,367,911 | 1/1945 | Wells | 131/84 R |
| 2,535,692 | 12/1950 | Molins et al. | 100/94 |
| 2,926,671 | 3/1960 | Carlson | 131/80 X |
| 3,234,950 | 2/1966 | Dearsley | 131/84 R |

*Primary Examiner*—Stephen C. Pellegrino

*Attorney, Agent, or Firm*—Snyder, Brown & Ramik

[57] ABSTRACT

Apparatus and method are disclosed for producing a compact strand of tobacco leaves in which the stems of the leaves are oriented predominantly longitudinally of the strand. Tobacco leaves distributed onto a horizontal conveyor in loose, randomly distributed fashion are subjected to progressive lateral crowding as they pass into a narrow channel section. The crowding effects displacement and/or deformation of leaves to achieve the desired orientation and the formation of the compacted strand. The crowding effect and the narrow channel section are afforded by upstanding endless conveyor flight portions overlying the horizontal conveyor and driven in the same direction and substantially the same speed as the horizontal conveyor.

30 Claims, 6 Drawing Figures

FIG.1
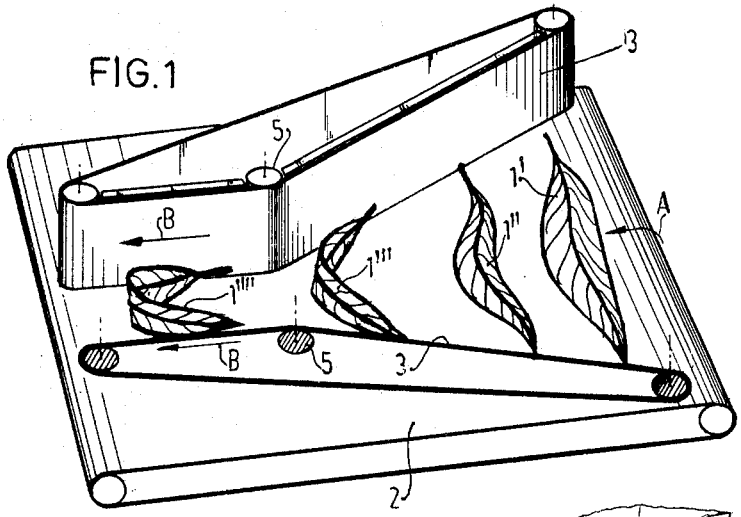
FIG.2
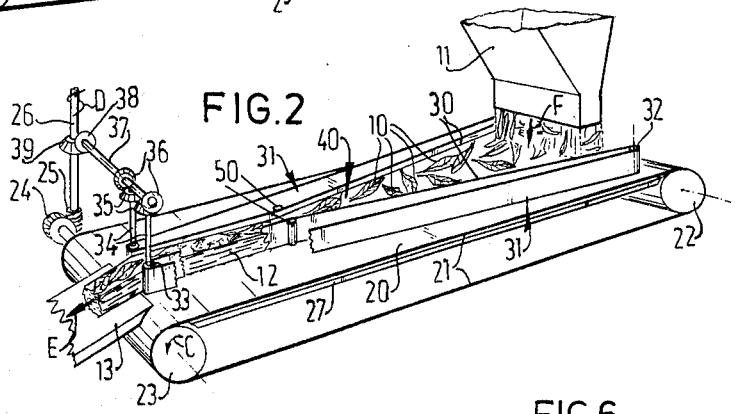
FIG.6
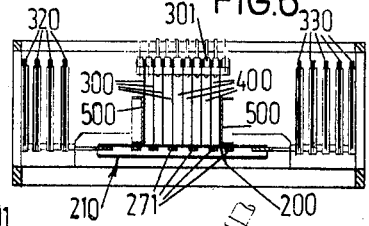
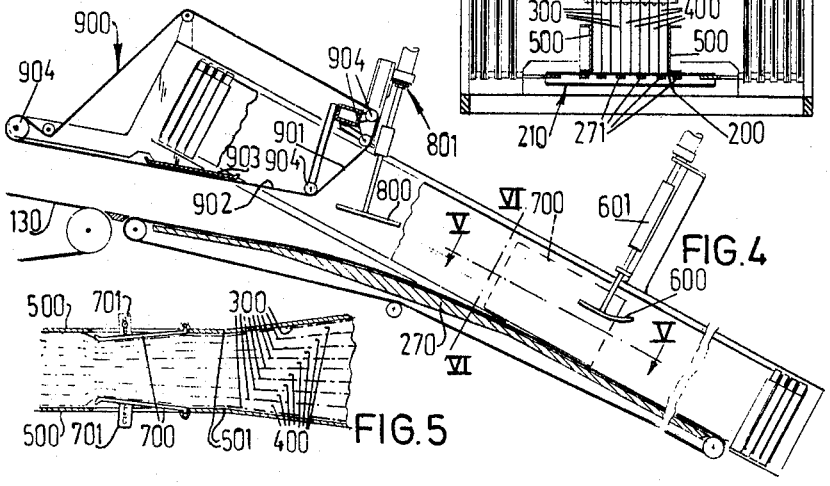
FIG.4
FIG.5
10505-AB

APPARATUS FOR ORIENTING TOBACCO LEAVES

This invention relates to apparatus for oreinting tobacco leaves and, more particularly, tobacco leaves which are to be processed into shredded tobacco.

In the case of tobacco leaves of this kind, it is important that the stalk of each leaf should be fed to a shredder in a direction which as far as possible is perpendicular to the shredding surface, since otherwise lengths of the stalk are shredded. These stalk lengths have a disturbing or damaging effect when cigarettes are rolled and must therefore be removed from the tobacco after the shredding operation, and in practice this means a very labor-intensive treatment. Stalk lengths shredded in the transverse direction of the leafstalk do not give rise to any problems and need not be removed. Consequently, the tobacco industry has devoted considerable effort to orient tobacco leaves prior to the shredding operation.

Although various kinds of apparatus have already been developed for orienting tobacco leaves, for example U.S. Pat. No. 3,367,475, the effect thereof is not very satisfactory in practice, so that tobacco leaves are still frequently oriented by hand. Since relatively small quantities of tobacco leaves are oriented per operation in such cases, this type of treatment requires considerable manpower. The temperature, relative humidity and odor conditions prevailing in such treatment also make it difficult to attract manpower to perform this method of treatment.

The invention disclosed herein provides method and apparatus for orienting tobacco leaves whereby both a considerable saving in manpower and also a higher and more uniform quality of the end product is obtained.

In general, the invention herein involves feeding tobacco leaves onto a conveyor in loosely distributed, randomly oriented fashion and then progressively laterally crowding or compressing the loose mass of leaves into a narrow channel. The narrow channel is of such a width that leaves which are most unfavorably oriented initially, i.e., transverse to the path of conveying, are displaced and/or deformed by the crowing so that their stems are oriented in the narrow channel to extend predominantly along the conveying path. The feed rate of the randomly oriented leaves is such that a compacted strand of tobacco is formed in the narrow channel which retains the desired orientation of the leaves.

The invention takes advantage of the fact that the stems are the stiffest portion of the leaf. Thus, a leaf which initially is oriented such that its stem lies obliquely across the path of conveying will tend to become displaced due to the stiffness of the stem as the leaf is subjected to the progressive crowding into the narrow channel. On the other hand, a leaf which intially lies essentially transverse to the conveying path may have its stem deformed progressively into a U-or V-shape as it is crowded into the narrow channel. In practice, any one leaf stem may of course be subjected to a combination of displacement and deformation but in any event the crowding together of the leaves into a narrow channel effects the formation of a compacted strand of tobacco in which the stems are oriented such that they extend predominantly longitudinally of the strand.

The basic arrangement of the invention involves a horizontal conveyor flight and at least two upstanding conveyor flights closely overlying the horizontal conveyor flight. The upstanding flights are constrained first to converge toward each other and then to extend generally parallel to each other, thus defining a trough-like channel having a tapered entrance section leading to a narrow channel section. The infeed of tobacco leaves is at such a rate that a compact strand of tobacco is formed in the narrow channel section whereas the tapered entrance section effects the lateral crowding or compressing action to achieve the progressive displacement and/or deformation of the stems as the lateral compression or compaction of the loose mass of leaves are moved toward and into the narrow channel section.

The invention will be explained further in the following description with reference to the accompanying drawings illustrating certain embodiments thereof, to which the invention is not limited however. In the drawings:

FIG. 1 is a diagrammatic perspective view showing the principle of the invention.

FIG. 2 is a diagrammatic perspective view showing a single embodiment of an apparatus according to the invention, certain components having been omitted for the sake of clarity.

FIG. 4 is an enlarged-scale side elevation and partial vertical section of an important part of the apparatus according to FIG. 3, certain components again having been omitted for the sake of clarity.

FIG. 5 is a section on the line V—V in FIG. 4 and

FIG. 6 is a section on the line VI—VI of FIG. 4, certain components again having been omitted for the sake of clarity.

Figure 3:
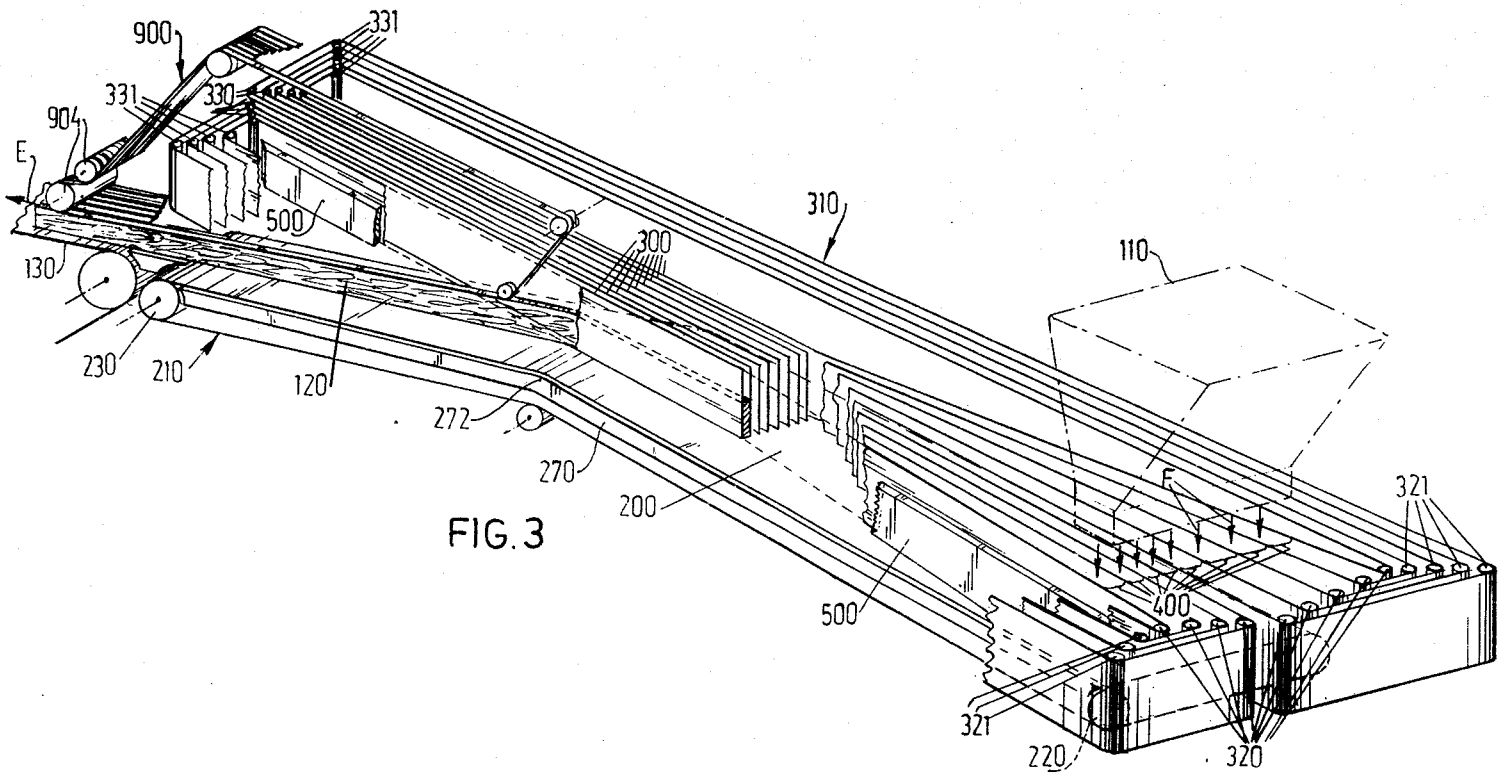
FIG. 3 is a diagrammatic perspective view showing a multiple embodiment of apparatus according to the invention, certain components again having been omitted for the sake of clarity.

The principle of the invention will first be explained with reference to FIG. 1. The most important elements shown in this Figure are four tobacco leaves 1 (1',1'',1'''and 1'''') conveyed on a conveyor belt 2 which is driven in the direction of arrow *a* and which acts as a carrier belt. The tobacco leaves 1 are enclosed laterally by a pair of conveyor belts 3 which extend vertically above the carrier belt 2 and which act as pressure belts and cooperate with the carrier belt 2 to define a channel 4 which is open at the top, and which in horizontal cross-section first tapers in the form of a funnel and then has an at least approximately constant width. The narrowing of this channel is produced by side elements which in this case are constructed as rollers 5 and which locally feed the two pressure belts 3 closer together. The belts 3 are driven at least approximately the same speed as the carrier belt 2 in substantially the same direction as the latter (see arrow B).

In order to clarify the view of the tobacco leaves 1, only the bottom outline of the foremost pressure belt 3 in FIG. 1 is illustrated. For the same reasons, most of the means for supporting and driving the conveyor belts 2 and 3 and the means for supplying and discharging the tobacco leaves 1 are shown diagrammatically, if at all, in FIG. 1. In addition, only four tobacco leaves 1 are illustrated, the longitudinal direction of the stalk of which, at the start of the carrier belt 2, i.e. on the right in FIG. 1, extends perpendicularly with respect to the direction of conveyance indicated generally by the arrows A and B. The four tobacco leaves respectively having the references 1', 1'', 1''' and 1'''' may be regarded as separate tobacco leaves, but it is also possible to consider the tobacco leaves 1', 1'', 1''' and 1'''' as a number of shapes successively assumed by such a transversely situated tobacco leaf as it moves through the channel 4. Of course, tobacco leaves can be transported within the channel 4 with the longitudinal direction of their stalk oriented in some other way, but FIG. 1 only illustrates tobacco leaves whose original shape 1' is as unfavourable as possible for further processing by the shredder (not shown in FIG. 1) adjoining the left-hand end of the carrier belt 2, the plane of cutting of the shredder extending in principle perpendicularly with respect to the direction of conveyance indicated by the arrows A and B. The stalk of the tobacco leaf 1' extends substantially parallel to the said plane of cutting so that the shredder would cut appreciable lengths out of the leafstalk if the tobacco leaves were fed with the shape or orientation as shown at 1'. As already stated, such stalk lengths cause considerable problems in the further processing of the shredded tobacco, more particularly in the hand-rolling of cigarettes, so that such parts have to be removed from the tobacco after shredding. This removal, which hitherto was frequently carried out manually, requires considerable effort. The apparatus according to the invention can prevent such lengths from being cut from the leafstalks so that subsequent sorting of such lengths after shredding is unnecessary.

The invention makes use of the difference in flexural stiffness between the leafstalk and the other softer parts of the tobacco leaf. If, as shown in FIG. 1, the pressure belts 3 are fed closer toether by the two rollers 5 as the belts move in the direction of conveyance indicated by arrows A and B, they will exert a substantially perpendicular compression force with respect to the direction of conveyance on the tobacco leaves in the channel 4, the longitudinal directions of the stalks differing from one another. Under the action of this compression force, a leafstalk already extending in the direction of conveyance to some degree will now tend to move as a whole to a greater degree than the other parts of the toabacco leaf which readily tend to bend and fold. This movement of the stalk is such that, as considered in the direction of conveyance, the stalk will ever-increasingly extend in said direction so that the required orienting effect is obtained. This orientation of tobacco leaves with leafstalks already extending in the direction of conveyance to some extent is not shown in FIG. 1 which simply shows the effect obtained in the case of tobacco leaves 1' having a leafstalk extending substantially transversely. It will be seen that with such a leaf 1' the above-described orienting effect is replaced by gradual bending of the leafstalk (see shapes 1'' and 1''') which may finally even result in bending of the stalk so that it has the shape of a U or V, the limbs of which do experience the required orienting effect (the shape 1''''). The bent part of the leafstalk will be of such dimensions with respect to a completely transversely situated stalk (shape 1') that practically no undersirably large stalk lengths remain in the shredded tobacco on subsequent processing by the shredder. The lengths cut from the stalk transversely do not generally cause any problems in the rolling of cigarettes, so that no special stalk parts have to be removed from the shredded tobacco after the shredding of tobacco leaves oriented by means of the invention. This means a considerable saving in manpower in comparison with the situation occurring heretofore in practice.

FIG. 2 is also a perspective and diagrammatic illustration of a simple embodiment of an orienting means according to the invention, although certain parts of the apparatus e.g. a sub-frame for mounting the various moving parts have been omitted for the sake of simplicity.

In the apparatus according to the invention as shown in FIG. 2, the tobacco leaves 10 are deposited by a feed hopper 11 on to the carrier surface 20 of a conveyor belt 21 acting as a carrier belt, the conveyor belt 21 running at both ends over rollers 22, 23 which are mounted on a subframe (not shown) and the roller 23 of which is rotated via a worm-wheel transmission 24, 25 (see arrow C), by a shaft 26 in turn rotated by a drive motor (not shown) — see arrow D. The operative surface 20 of the carrier belt 21 is supported on the underside by a support plate 27 extending parallel to the carrier surface 20 and secured to the subframe (not shown).

The operative surfaces 30 of two conveyor belts 31 extend vertically opposite one another immediately above the carrier surface 20, said conveyor belts 31 acting as pressure belts and running at both ends respectively over rollers 32, 33, the latter also being coupled for rotation to the above mentioned drive shaft 26 via shafts 34, gears 35, 36, a common intermediate shaft 37 and a gear 38, 39.

The transmission ratios of the various transmissions 24, 25; 35, 36 and 38, 39 are so selected that the operative surfaces 30 of the pressure belts 31 move at at least approximately the same speed as the carrier surface 20 of the carrier belt 21. The carrier surface 20 and the two operative surfaces 30 together form a channel 40 which is open at the top and which conveys from right to left in FIG. 2 the tobacco leaves 10 falling from the feed hopper 11. The distance between the rollers 32 and the right-hand end of the pressure belts 31 is greater than that of the rollers 33 at the left-hand end of the pressure belts. The channel 40 thus has initially a converging shape in the form of a funnel in horizontal cross-section. In addition, as considered in the direction of conveyance of the apparatus as defined by the direction of movement of the carrier surface 20, two rollers 50 are situated some distance in front of the rollers 33 of the pressure belts 31 and have the same distance between them as the rollers 33 and are mounted in parallel to the rollers 33 (although not shown in the drawing) and bear over at least part of their length against the back of one of the pressure surfaces 30. The channel 40 thus has at least an approximately constant width between the rollers 50 and the rollers 33.

The tobacco leaves 10 falling on to the carrier surface 20 from the feed hopper 11 will now be subjected to compression forces by the operative surfaces 30 in that part of the channel 40 which extends between the rollers 32 and the rollers 50 and which converges in the direction of conveyance, the said compression forces being such in the direction perpendicular to the direction of conveyance that the orienting effect described with reference to FIG. 1 takes place. Consequently, a compact stream 12 of tobacco leaves with their leafstalks oriented at least substantially in the direction of conveyance moves in that part of the channel 40 which extends between the rollers 50 and the rollers 33. This stream 12 passes from the left-hand end of the apparatus according to FIG. 2 in the form of a self-sustaining, compact strand onto the discharge means illustrated symbolically by the element 13 (see arrow E); said discharge means may, for example, be the feed conveyor of a shredder (not shown), which does not itself form part of the invention.

With the simple embodiment of the orienting means according to the invention as described which reference to FIG. 2, only horizontally-extending compression forces are exerted on the tobacco leaves 10 conveyed within the channel 40. According to the invention, however, it is advantageous also to apply vertical compression forces to the tobacco leaves. This is embodied in the multiple embodiment of the orienting means according to the invention as described in detail with reference to FIGS. 3–6 hereinafter. A multiple embodiment of this kind is preferable in practice.

Although FIG. 3 is a diagrammatic view it is the most readily perceptible view of a multiple orienting apparatus according to the invention comprising a number of components equivalent to those of a single orienting apparatus and a number of parts which differ therefrom in principle. For the sake of clarity, a number of parts have been omitted or simply shown partially or diagrammatically in FIG. 3.

On the right-hand side of the apparatus in FIG. 3, the broken lines denote a feed hopper 110 extending over the entire width of the apparatus and of any suitable type. Tobacco leaves fall from this feed hopper 110 - which may have a quite different shape or be of quite different construction — and although not shown in FIGS. 3–6 the tobacco leaves drop on to the carrier surface 200 of a conveyor belt 210 which acts as a common carrier belt and which at its two ends runs over rollers 220, 230, the latter of which is driven (see arrow C) in a comparable manner to FIG. 2, The associated drive means are now shown in FIGS. 3-6 and the same applies to the sub-frame on which the rollers 220 and 230 are mounted. The carrier surface 200 of the carrier belt is supported on its underside by a support plate 270 which extends parallel thereto and which is of a grid-like construction, consisting of a number of parallel bars 271 (see FIG. 6) extending in the longitudinal direction of the carrier surface 200. For reasons to be described hereinafter, the support plate 270 is bent obliquely downwards with respect to its original plane at a specific point between the rollers 220 and 230. At the bend, the support plate 270 - i.e. each of the bars 271 - engages the underside of the carrier surface 200 along an action line 272 for a number of action lines 272 together forming a bent surface of a guide element. In the embodiment shown in FIG. 3, the support plate 270 — i.e. each of the grid bars 271 - consists of a unit bent along a group of action lines 272. Alternatively, the support plate 270, i.e. each of the grid bars 271 - may consist of two straight portions to give a support plate structure which, as it were, is bent along an action line 272. In that case, it is also possible to provide a guide roller between the two flat portions of the support plate, said guide roller extending in the longitudinal direction over the entire width of the carrier surface 200 and its generatrices forming the lines of action 272. It is in any case important that the line or lines of action 272 should extend parallel to, but above, the top joint contact plane to the two rollers 220, 230 respectively. The result of this step, the purpose of which will be explained in detail hereinafter, is in any case to ensure that the carrier surface 200 extends (and can move) from roller 220 to the first or any line of action 272 with its longitudinal axis in the direction of conveyance and extend between the any or last line of action 272 and the roller 230 obliquely downwards with respect to said direction of conveyance.

The vertical operative surfaces 300 of a number of consecutive conveyor belts 310 acting as pressure belts extend vertically above the carrier surface 200 of the joint carrier belt 210 and are driven in the said direction of conveyance, the said conveyor belts 310 running at their ends over rollers 320 and 330 which have their longitudinal axis extending vertically and the latter one of which is rotated by drive means not shown in FIGS. 3–6. In the apparatus illustrated in the drawing, nine pressure belts 310 are used, four of which are disposed on one side of the apparatus and five on the other side of the apparatus, each extending around one another (see FIGS. 3 and 6). The nine operative surfaces 300 of these pressure belts together with the carrier surface 200 of the common carrier belt 210 extending immediately therebeneath, define eight channels 400, into which the tobacco leaves fed via the feed hopper 110 fall (see arrows F in FIG. 3). As will be clearest from FIG. 3, the seven innermost operative surfaces 300 as considered in the horizontal direction perpendicular to the direction of conveyance operate to two sides, while the two outermost operative surfaces 300 in the same direction operate only to one side, i.e. inwards. Side plates 500 fixed to the apparatus subframe (not shown) - see FIGS. 3, 5 and 6 — press against the outside of the said two operative surfaces 300 over the entire length of the surfaces extending in the direction of conveyance. These side plates serve for lateral support of the outermost operative surfaces 300. As will be apparent from FIG. 3 and more particularly FIG. 5, the side plates 500 - which of course extend in vertical planes - converge in the horizontal plane starting from the rollers 320 where they approximately begin, in the direction of conveyance as far as bend line 501, along which they are bent, then extend parallel to one another in the direction of conveyance. Of course continuous side plates 500 bent to a bend line 501 may be replaced by multipart side plates, two parts of which abut at an angle at the bend line 501. Alternatively, a separate elongate side element may be provided at the bend line 501, said element pressing against the back of the outermost operative surface and may, for example, be a vertical roller. The bend line 501 therefore represents any suitable side element. It is essential that the distance between the two bend lines 501 pressing against the back of their associated outermost operative surfaces 300 should be less than the distance between the rollers 320 supporting the two outermost operative surfaces at their beginning. This of course results in the operative surfaces 300 converging in the horizontal plane or tapering at an angle so that the tobacco leaves in the channels 400 defined by the operative surfaces are subjected to horizontal compression forces perpendicular to the direction of conveyance to give the desired oriented effect.

The following is now important. It will be assumed that the feed hopper 110 provides a uniform supply of tobacco leaves over the entire width of the eight channels 400 so that the eight channels are filled uniformly. Consequently, the forces exerted on the two outermost operative surfaces 300 by the side plates 500 will be transmitted - via the tobacco leaves in the two outermost channels 400 - to the more inwardly-extending operative surfaces 300 as considered in the horizontal transverse direction with respect to the direction of conveyance, and so on. If all the channels 400 are filled uniformly, the more inwardly situated operative surfaces 300 will thus automatically extend as shown in FIG. 5 despite the fact that they are not supported by mechanical means at their underside. As shown diagrammatically in FIG. 6, the operative surfaces 300 are guided at their top edge by a rail structure 301 which can be constructed in any suitable manner and will not be described in detail here.

For the sake of completeness it should be pointed out that the outermost of the pressure belts 300 disposed one around the other, on the right in FIG. 3, are passed not only around the rollers 320 but also around more outwardly disposed rollers 321 and, on the left in FIG. 3, are passed not only around the said rollers 330 but also around more outwardly disposed rollers 331. The positions of, and the distances between, the various rollers 320, 321 and 330, 331 are always so selected as to give the configuration shown in FIGS. 3 and 5 for the operative surfaces 300 of the pressure belts 310.

It will be apparent from the description of this part of the multiple orienting apparatus according to FIGS. 3–6 how the tobacco leaves are subjected to compression forces horizontally by the operative surfaces 300 of the pressure belts as the leaves are conveyed through the channels 400, so that the required orienting effect is obtained. However, with the apparatus described, there is also a vertical compression of the tobacco leaves inside the channel as will now be described with reference to FIG. 4.

As already stated, a grid-like support plate 270 extends beneath the carrier surface 200 of the joint carrier belt 210 and is shown in longitudinal section in FIG. 4. As also will be apparent from this Figure, a pressure element in the form of a pressure shoe 600 also extends above the carrier surface 200 inside each conveyor channel 400. The pressure shoe and the common pressure-medium-actuated jack 601 for the drive for all the pressure elements have been omitted from FIG. 3 for the sake of clarity. On actuation of the jack system 601 secured to the apparatus subframe, the system will move downwardly the eight pressure shoes extending within the channel 400 so that the tobacco leaves therebeneath are subjected to substantially vertical compression forces perpendicular to the direction of conveyance between the support plate 270 and the carrier surface 200 bearing thereon, on the one hand, and the underside of the pressure shoe 600 on the other hand, thus intensifying the required orienting effect.

After passing their associated pressure shoe 600, the channels 400 are therefore filled with tobacco leaves which to a relatively considerable degree are compressed in perpendicular directions to the conveying direction and which exert relatively considerable reaction forces on the operative surfaces 300. For reasons to be described hereinafter, it is preferable, however, for the tobacco leaves compressed within the channels 400 not to exert such forces on the operative surfaces 300 as to give rise to problems in releasing such leaves. To this end, a pressure element which in this case is in the form of a pressure plate 700 is disposed at some distance behind the bend lines 501 on the inside of each side plate 500 and results in a temporary constriction of the conveyor channels 400. After passing the pressure plates 700 or the resulting constriction, the masses of tobacco leaves which have been temporarily additionally compressed laterally, can again expand to some extent in the outward direction, but the forces exerted on the operative surfaces 300 of the pressure belts 310 by the masses of tobacco leaves will be less than in front of the pressure elements 700. The latter are disposed to be adjustable by means of an adjusting system 701 which will not be described in greater detail, at a place which, as considered in the direction of conveyance, is situated after the pressure shoes 600 but in front of the line of action 272 of the support plate 270 or other guide element. The adjustment of the two pressure plates 700 is best determined in practice by means of the system 701, and it may prove that the pressure plates 700 can be completely omitted.

As a result of the step s described heretofore, eight masses of tobacco leaves will move during operation in the channels 400 in the direction of conveyance, i.e., the longitudinal direction of the operative surfaces 300. Since the latter form part of the pressure belts 310 one around the other, the masses of tobacco leaves must be removed from the channels 400 before the operative surfaces 300 reach the rollers 330 disposed at the left-hand end of the apparatus. If this requirement is not satisfied, the masses of tobacco leaves 120 compressed for orientation of the leafstalks (see FIG. 3) would partially collide against the rollers 330 and partially pass the latter at the end of the operative surfaces 300 so that the orienting effect obtained would be lost and proper operation of the operative surfaces 300 would be disturbed.

Removal of the tobacco leaves 120 from the channels 400 after passing the pressure plates 700 takes place in the vertical downward direction and is possible because the common carrier surface 200 of the carrier conveyor belt 210 is bent in an obliquely downward direction at the line or lines of action 272 of the support plate 270 or other guide element, out of the original direction of conveyance in which the operative surfaces 300 of the pressure belts 310 continue to move (see FIG. 4).

Where the carrier surface 200 begins to bend in an obliquely downward direction with respect to the direction of conveyance, any masses of tobacco leaves 120 which may have relaxed to some extent as a result of the effect of the pressure plates 700 can slide down along the operative surfaces 300 in principle under the action of just the force of gravity and thus land on the bent part of the carrier surface 200. In many cases, however, this will be insufficient guarantee for good release of the oriented tobacco leaves.

In view of this, a shoe 800 acting as an engaging element is provided after the line or lines of action 272 of the support plate 270 or other guide element in each channel as considered in the direction of conveyance and can engage from above the mass of tobacco leaves 120 in a channel 400 for movement thereof in a downward direction so that the mass 120 lands on the bent part of the carrier surface 200 situated therebeneath. FIG. 4 shows an engaging shoe 800 of this kind together with the jack system 801 provided as the common drive for all the shoes 800 and secured to the apparatus subframe, said system 801 being pressure-medium-actuated and not described in detail here. A continuously or periodically operating programme can be used to actuate the jack system 801 and to actuate the previously-mentioned jack system 601 for driving the pressure shoe 600.

After the engaging element 800 as considered in the direction of conveyance, a narrow conveyor belt 900 is provided between each two adjacent operative surfaces 300 and first moves obliquely downwards by a sloping part 901 and then moves with a horizontal part 902 parallel to and above the left-hand part of the carrier surface 2. At the top, the horizontal part 902 may be supported over at least a part of its length by a fixed pressure plate 903. The various conveyor belts 900 run over a number of rollers 904, the corresponding rollers 904 of the different conveyor belts 900 being at least partly coupled by shafts for common rotation, although this is not described in detail.

A shredder may, for example, immediately follow the left-hand end of the carrier surface 200 of the apparatus. The shredder itself does not form part of the invention and is simply denoted symbolically in FIG. 4 by means of its feed conveyor 130. The masses of tobacco leaves 120 falling from the channels 400 and moved downwardly by the shoes 800 and accompanied by the horizontal part 902 of the conveyor belt 900 rest laterally against one another and form practically a whole after being released from the operative surfaces 300 and can be fed in a continuous stream to the conveyor 130 between the horizontal part 902 of the conveyor belt 900 and the left-hand part of the carrier surface 200. Instead of being the feed conveyor for an immediately adjoining shredder, the conveyor 130 may of course alternatively serve as a conveyor to a shredder situated at a greater distance, or to some other processing machine.

As will be apparent from the foregoing, the invention provides an apparatus whereby the orienting of the leafstalks of tobacco leaves is possible completely automatically. The compression forces exerted on the tobacco leaves perpendicularly to the direction of conveyance subject the leafstalks to orienting forces which produce the required orienting effect. Although manpower is still used in practice to check proper operation of the apparatus and more particularly to check uniform tobacco leaf feed and good delivery of tobacco leaves subjected to compression forces, the apparatus according to the invention provides a considerable saving in manpower required for the actual orienting of the tobacco leaves. It has also been found in practice that the orienting effect obtained with the apparatus according to the invention has advantages over the orienting effect provided by manpower. There is no need to remove lengths of stalk from the tobacco leaves fed to a shredder after first passing through an apparatus according to the invention although such removal is necessary where tobacco leaves have been oriented by manpower.

The invention is not limited to the embodiments described hereinbefore and illustrated in the drawing. Various modifications can be made to the parts described and to their relationship to one another without thereby departing from the scope of the invention.

What is claimed is:

1. Apparatus for conveying tobacco leaves to a shredding machine while orienting them such that the stems of the tobacco leaves will in large part be presented essentially perpendicular to the cutting plane of the shredder, comprising in combination:

horizontally extending conveyor means for receiving tobacco leaves in randomly distributed fashion and conveying them along a predetermined path;

tobacco leaf feed means for feeding tobacco leaves loosely onto said conveyor means at one region thereof; and compressing means extending downstream of said one region for laterally compressing the loose tobacco leaves while displacing and deforming tobacco leaves which reside generally transverse to said path into a disposition in which the stems thereof largely extend longitudinally with respect to said path, said compressing means comprising upstanding conveyor elements extending first convergently with respect to each other and then in generally parallel relation whereby to define a trough-like channel having a tapered entrance section, means for driving said upstanding conveyor elements in the same direction and at essentially the same speed as said horizontally extending conveyor means, and said horizontal conveyor means including a portion which angles downwardly away from said upstanding conveyor elements beyond said tapered entrance section of the channel, and including deflector means disposed between said upstanding conveyor elements for crowding the compacted tobacco leaves downwardly to escape from between said upstanding conveyor elements.

2. Apparatus as defined in claim 1 including vertical compactor means disposed upstream from said deflector means for vertically compacting the tobacco leaves upon said horizontally extending conveyor means.

3. Apparatus as defined in claim 1 wherein said compressing means comprises a series of upstanding, endless conveyor means disposed in nested relation and presenting at least two upstanding flight elements travelling in the same direction and converging first toward each other and then in generally parallel relation to define a trough-like channel having a tapered entrance section.

4. Apparatus as defined in claim 3 wherein said horizontal conveyor means includes a portion which angles downwardly away from said upstanding conveyor elements beyond said tapered entrance section of the channel, and including deflector means disposed between said upstanding conveyor elements for crowding the compacted tobacco leaves downwardly to escape from between said upstanding conveyor elements.

5. Apparatus as defined in claim 4 including vertical compactor means disposed upstream from said deflector means for vertically compacting the tobacco leaves toward said horizontally extending conveyor means.

6. Apparatus as defined in claim 4 wherein said deflector means comprises an endless conveyor disposed in a vertical plane and including a flight portion angling downwardly between said upstanding flight elements.

7. Apparatus as defined in claim 6 including vertical plate means reacting against said upstanding flight elements to maintain them in converging relation in opposition to separating forces exerted by said tobacco leaves.

8. Apparatus as defined in claim 7 wherein said horizontal conveyor means includes a portion which angles downwardly away from said upstanding conveyor elements beyond said tapered entrance section of the channel, and including deflector means disposed between said upstanding conveyor elements for crowding the compacted tobacco leaves downwardly to escape from between said upstanding conveyor elements.

9. Apparatus as defined in claim 8 including vertical compactor means disposed upstream from said deflector means for vertically compacting the tobacco leaves upon said horizontally extending conveyor means.

10. Apparatus as defined in claim 7 including a pair of pressure plates projecting through said plate means and disposed in converging relation to each other to define a constriction in the path of the compacted tobacco leaves.

11. Apparatus for conveying tobacco leaves to a shredding machine while orienting them such that the stems of the tobacco leaves will in large part be presented essentially perpendicular to the cutting place of the shredder, comprising in combination:

horizontally extending conveyor means for receiving tobacco leaves in randomly distributed fashion and conveying them along a predetermined path;

tobacco leaf feed means for feeding tobacco leaves loosely onto said conveyor means at one region thereof; and compressing means extending downstream of said one region for laterally compressing the loose tobacco leaves while displacing and deforming tobacco leaves which reside generally transverse to said path into a disposition in which the stems thereof largely extend longitudinally with respect to said path, said compressing means comprising upstanding conveyor elements extending first convergently with respect to each other and then in generally parallel relation whereby to define a troughlike channel having a tapered entrance section, said horizontal conveyor means including a portion which angles downwardly away from said upstanding conveyor elements beyond said tapered entrance section of the channel, and including deflector means disposed between said upstanding conveyor elements for crowding the compacted tobacco leaves downwardly to escape from between said upstanding conveyor elements.

12. Apparatus as defined in claim 11 including vertical compactor means disposed upstream from said deflector means for vertically compacting the tobacco leaves toward said horizontally extending conveyor means.

13. Apparatus for conveying tobacco leaves to a shredding machine while orienting them such that the stems of the tobacco leaves will in large part be presented essentially perpendicular to the cutting plane of the shredder, comprising in combination:

horizontally extending conveyor means for receiving tobacco leaves in randomly distributed fashion and conveying them along a predetermined path;

tobacco leaf feed means for feeding tobacco leaves loosely onto said conveyor means at one region thereof; and compressing means extending downstream of said one region for laterally compressing the loose tobacco leaves while displacing and deforming tobacco leaves which reside generally transverse to said path into a disposition in which the stems thereof largely extend longitudinally with respect to said path, said compressing means comprising upstanding conveyor elements extending first convergently with respect to each other and then in generally parallel relation whereby to define a trough-like channel having a tapered entrance section, means for driving said upstanding conveyor elements in the same direction and at essentially the same speed as said horizontally extending conveyor means, vertical plate means reacting against said conveyor elements to maintain them in converging relation in opposition to separating forces exerted by said tobacco leaves, and means for driving said upstanding conveyor elements in the same direction and at essentially the same speed as said horizontally extending conveyor means, said horizontal conveyor means including a portion which angles downwardly away from said upstanding conveyor elements beyond said tapered entrance section of the channel, and including deflector means disposed between said upstanding conveyor elements for crowding the compacted tobacco leaves downwardly to escape from between said upstanding conveyor elements.

14. Apparatus as defined in claim 13 including vertical compactor means disposed upstream from said deflector means for vertically compacting the tobacco leaves upon said horizontally extending conveyor means.

15. Apparatus for conveying tobacco leaves to a shredding machine while orienting them such that the stems of the tobacco leaves will in large part be presented essentially perpendicular to the cutting plane of the shredder, comprising in combination:

horizontally extending conveyor means for receiving tobacco leaves in randomly distributed fashion and conveying them along a predetermined path;

tobacco leaf feed means for feeding tobacco leaves loosely onto said conveyor means at one region thereof; and compressing means extending downstream of said one region for laterally compressing the loose tobacco leaves while displacing and deforming tobacco leaves which reside generally transverse to said path into a disposition in which the stems thereof largely extend longitudinally with respect to said path said compressing means comprising upstanding conveyor elements extending first convergently with respect to each other and then in generally parallel relation whereby to define a trough-like channel having a tapered entrance section, said horizontal conveyor including a portion which angles downwardly away from said upstanding conveyor elements beyond said tapered entrance section of the channel, and including deflector means disposed between said upstanding conveyor elements for crowding the compacted tobacco leaves downwardly to escape from between said upstanding conveyor elements, and including support means for said horizontal conveyor means.

16. Apparatus as defined in claim 15 wherein said support means comprises a plurality of spaced bars underlying said horizontal conveyor means.

17. Apparatus for conveying tobacco leaves to a shredding machine while orienting them such that the stems of the tobacco leaves will in large part be presented essentially perpendicular to the cutting plane of the shredder, comprising in combination:

horizontally extending conveyor means for receiving tobacco leaves in randomly distributed fashion and conveying them along a predetermined path;

tobacco leaf feed means for feeding tobacco leaves loosely onto said conveyor means at one region thereof; and compressing means extending downstream of said one region for laterally compressing the loose tobacco leaves while displacing and deforming tobacco leaves which reside generally transverse to said path into a disposition in which the stems thereof largely extend longitudinally with respect to said path, said compressing means comprising upstanding conveyor elements extending first convergently with respect to each other and then in generally parallel relation whereby to define a trough-like channel having a tapered entrance section, vertical plate means reacting against said conveyor elements to maintain them in converging relation in opposition to separating forces exerted by said tobacco leaves, and a pair of pressure plates projecting through said plate means and disposed in converging relation to each other to define a constriction in the path of the compacted tobacco leaves.

18. Apparatus for conveying tobacco leaves to a shredding machine while orienting them such that the stems of the tobacco leaves will in large part be presented essentially perpendicular to the cutting plane of the shredder, comprising in combination:

horizontally extending conveyor means for receiving tobacco leaves in randomly distributed fashion and conveying them along a predetermined path;

tobacco leaf feed means for feeding tobacco leaves loosely onto said conveyor means at one region thereof; and compressing means extending downstream of said one region for laterally compressing the loose tobacco leaves while displacing and deforming tobacco leaves which reside generally transverse to said path into a disposition in which the stems thereof largely extend longitudinally with respect to said path, said compressing means comprising first and second sets of upstanding endless conveyor means, each set comprising a series of upstanding endless conveyor means disposed in nested relation and defining at least two upstanding flight elements travelling in the same direction and converging toward each other, the outer flight elements of the two sets which travel in the same direction being backed by convergent plate means for resisting spreading forces exerted by the tobacco leaves while being compacted.

19. Apparatus as defined in claim 18 wherein said horizontal conveyor means includes a portion which angles downwardly away from said upstanding flight portions, and including deflector means interposed between said flight portions for crowding the compacted tobacco leaves downwardly onto said horizontal conveyor means.

20. Apparatus as defined in claim 19 including support means for said horizontal conveyor means.

21. Apparatus as defined in claim 20 wherein said support means comprises a plurality of spaced bars underlying said horizontal conveyor means.

22. Apparatus as defined in claim 21 wherein said deflector means comprises a series of endless conveyor belts disposed in side-by-side relation and angling downwardly between said flight portions.

23. Apparatus as defined in claim 22 including vertical compacting means upstream of said deflector means for vertically compacting tobacco leaves in the channel defined between adjacent upstanding flight portions.

24. Apparatus as defined in claim 19 wherein said deflector means comprises a series of endless conveyor belts disposed in side-by-side relation and angling downwardly between said flight portions.

25. Apparatus as defined in claim 24 including vertical compacting means upstream of said deflector means for vertically compacting tobacco leaves in the channel defined between adjacent upstanding flight portions.

26. Apparatus for compacting loose tobacco leaves into a strand in which the stems of the leaves are oriented predominantly longitudinally of the strand, comprising in combination:

compactor and conveyor means for forming said strand and feeding it toward a shredder which shreds the strand transversely, said compactor and conveyor means including a horizontal flight portion and upstanding members overlying said flight portion to define a troughlike channel, said upstanding members extending first in converging relation to each other in the direction of said flight portion to form a tapered entrance region of said channel which will accept tobacco leaves transversely and then extending generally parallel to each other to define a narrow channel length which is of a width as will bend a transversely disposed tobacco leaf into U-shape such that its stem extends predominantly longitudinally of said narrow channel;

means for distributing tobacco leaves onto said flight portion to enter said tapered region of the channel at such a rate as will form the compacted strand in said narrow channel length, said upstanding members being formed by upstanding flight portions of at least two upstanding endless conveyor means, each of the upstanding flight portions being backed by an upstanding plate means, and said horizontal flight portion being supported by horizontal support means which angles downwardly away from said upstanding flight portions below said narrow channel region, and deflector means interposed between said upstanding flight portions within said narrow channel region for crowding said strand downwardly onto said horizontal flight portion to escape from between said upstanding flight portions.

27. Apparatus as defined in claim 26 including vertical compacting means disposed between said upstanding flight portions upstream from said deflector means.

28. Apparatus as defined in claim 27 wherein said deflector means comprises endless conveyor means disposed a vertical plane and having a flight portion angling downwardly within said narrow channel length generally parallel to the underlying horizontal flight portion.

29. Apparatus for compacting loose tobacco leaves into a strand in which the stems of the leaves are oriented predominantly longitudinally of the strand, comprising in combination:

compactor and conveyor means for forming said strand and feeding it toward a shredder which shreds the strand transversely, said compactor and conveyor means including a horizontal flight portion and upstanding members overlying said flight portion to define a troughlike channel, said upstanding members extending first in converging relation to each other in the direction of said flight portion to form a tapered entrance region of said channel which will accept tobacco leaves transversely and then extending generally parallel to each other to define a narrow channel length which is of a width as will bend a transversely disposed tobacco leaf into U-shape such that its stem extends predominantly longitudinally of said narrow channel;

means for distributing tobacco leaves onto said flight portion to enter said tapered region of the channel at such a rate as will form the compacted strand in said narrow channel length, said upstanding members being defined by flight portions of a series of upstanding, nested endless conveyors defining a plurality of channels therebetween.

30. Apparatus as defined in claim 29 wherein there are two sets of said series of upstanding, nested endless conveyors.

* * * * *